United States Patent [19]

Deutsch

[11] 4,205,580

[45] Jun. 3, 1980

[54] ENSEMBLE EFFECT IN AN ELECTRONIC MUSICAL INSTRUMENT

[75] Inventor: Ralph Deutsch, Sherman Oaks, Calif.

[73] Assignee: Kawai Musical Instrument Mfg. Co. Ltd., Hamamatsu, Japan

[21] Appl. No.: 917,922

[22] Filed: Jun. 22, 1978

[51] Int. Cl.[2] ..... G10H 1/02

[52] U.S. Cl. ..... 84/1.24; 84/DIG. 4

[58] Field of Search ..... 84/1.24, 1.25, DIG. 4; 340/354

[56] References Cited

U.S. PATENT DOCUMENTS

| | | | |
|---|---|---|---|
| 3,882,751 | 5/1975 | Tomisawa et al. | 84/1.26 |
| 3,884,108 | 5/1975 | Deutsch | 84/1.24 |
| 3,978,755 | 9/1976 | Woron | 84/DIG. 4 |
| 4,031,795 | 6/1977 | Bunger | 84/1.25 |
| 4,064,778 | 12/1977 | Uchiyama | 84/1.25 |
| 4,072,079 | 2/1978 | Sharp | 84/1.25 |
| 4,078,466 | 3/1978 | Suenaga et al. | 84/1.25 |
| 4,080,861 | 3/1978 | Wholahan | 84/1.25 |
| 4,085,644 | 4/1978 | Deutsch et al. | 84/1.01 |
| 4,112,803 | 9/1978 | Deutsch | 84/1.24 |

*Primary Examiner*—J. V. Truhe
*Assistant Examiner*—Forester W. Isen
*Attorney, Agent, or Firm*—Christie, Parker & Hale

[57] ABSTRACT

An ensemble effect is produced in a digital tone generator by providing a master data set of words having values corresponding to the relative amplitudes of equally spaced points along one cycle of the waveform of the audio tone. These values are transferred sequentially during repetitive cycles at a rate proportional to the pitch of the desired musical tone to a digital-to-analog converter for converting the master data set to an audio signal of the desired waveform and pitch. The ensemble effect is produced by transferring the words of the master data set to a second converter at the same pulse rate but having one value deleted or repeated once in the second set. Because the second set :has one less or one extra value in the set, the resulting audio tones from the two sets change phase with each successive cycle of the audio signals.

17 Claims, 8 Drawing Figures

ENSEMBLE EFFECT IN AN ELECTRONIC MUSICAL INSTRUMENT

FIELD OF THE INVENTION

This invention relates to electronic musical tone synthesizers, and more particularly, is concerned with a digital tone generator producing an ensemble effect.

BACKGROUND

An ensemble effect is achieved when a musical tone sounds like it comes from more than one instrument. A note played by a group of violins sounds different than the same note played by a single violin. The ensemble effect is produced by the resulting combination of tones of nominally the same but of slightly unequal pitches of the several instruments. The ensemble effect is further enhanced by differences in the tonal quality of the different instruments. Therefore, to reproduce the "warmth" of tone associated with the ensemble effect by a tone synthesizer, it is desirable to create multiple tones which differ slightly both in pitch and in tonal quality.

The generation of tones producing an ensemble effect in electronic musical instruments is well-known. See, for example, U.S. Pat. Nos. 3,347,973; 3,429,978; 3,884,108; and 3,978,755. Each of these patents disclose methods for producing an ensemble effect by generating frequencies which are offset from the true musical frequency. This has been accomplished in such prior art patents by utilizing multiple tone generators. In copending application Ser. No. 644,450, filed Dec. 29, 1975, entitled "Ensemble and Harmonic Generation in a Polyphonic Tone Synthesizer" and filed by the same inventor as the present application, there is described an ensemble system for a polyphonic digital tone synthesizer capable of producing tones which differ in pitch as well as in tonal quality. This is accomplished by providing separate digital tone generators and requires multiple master data sets to be computed to control the waveforms generated by the several tone generators.

SUMMARY OF THE INVENTION

The present invention is directed to apparatus for producing an ensemble effect in a polyphonic tone synthesizer in which the tonal effect of multiple tones is created by a single tone generator which uses a single master data set.

This is accomplished, in brief, by providing a tone generator having a pair of sift registers for storing the same master data set defining equally-spaced points along one cycle of the waveform of a musical tone to be generated. Words are shifted out of the two registers in synchronism by a single clock source at a frequency which is proportional to the desired pitch of the tone being generated. The words are transferred successively out of the two registers to digital analog converting means during repetitive cycles. By having one register either store one word in the data set twice, or store one less than all the words of the master data set, each repetitive cycle produces one additional word delay between the corresponding words of the master data set at the outputs of the two registers. The resulting combined audio signals thus effectively shift in phase by one clock time during each repetitive cycle, thereby producing an ensemble tone which is the composite of two tones that are slightly different in frequency and in harmonic content.

DESCRIPTION OF THE DRAWINGS

For a better understanding of the invention, reference should be made to the accompanying drawings wherein.

DETAILED DESCRIPTION

The preferred embodiment of the present invention is described as an improvement to the polyphonic tone synthesizer described in detail in U.S. Pat. No. 4,085,644 hereby incorporated by reference. However, the principals of the invention can be applied to other types of digital tone generators.

Figure 1:
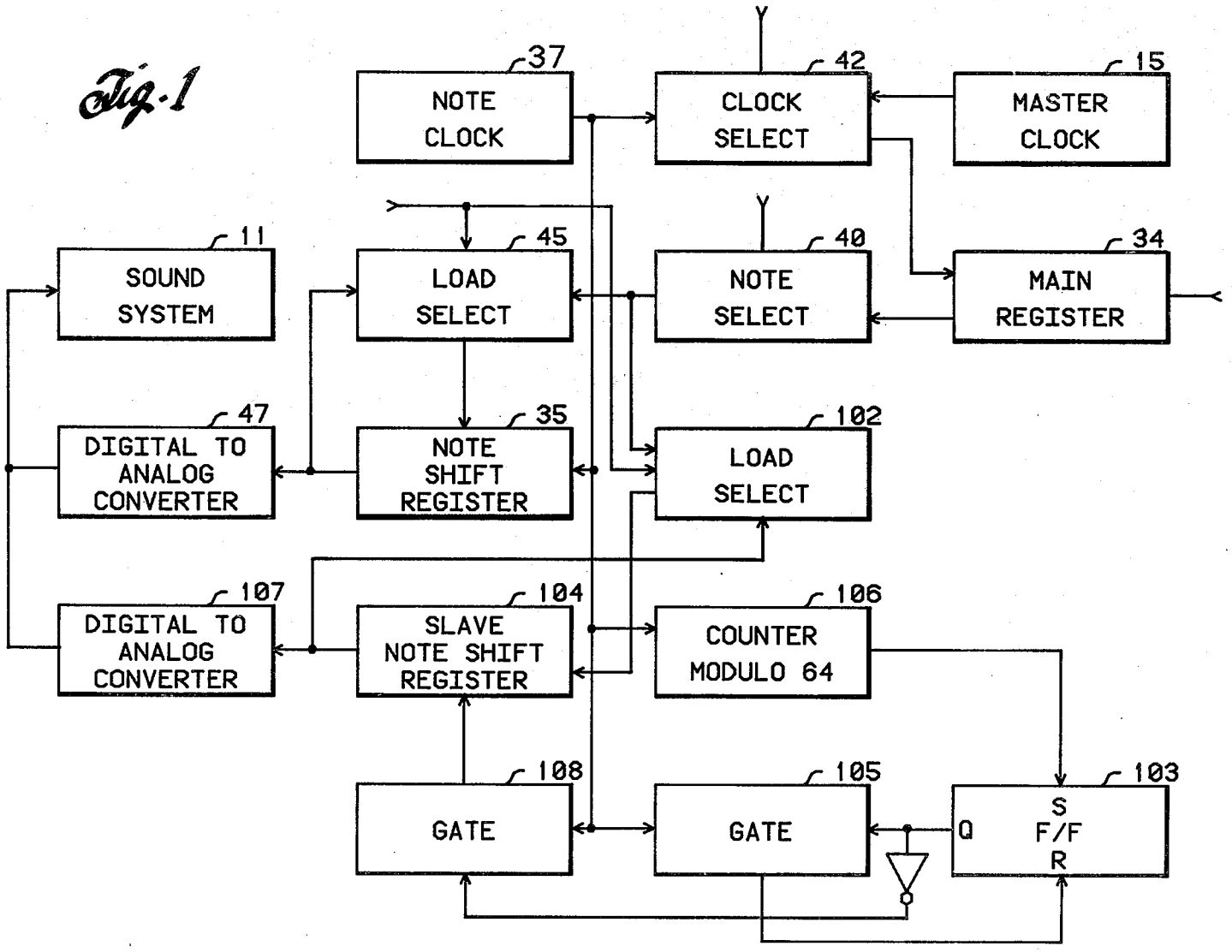
FIG. 1 is a schematic block diagram of a preferred embodiment of the invention.

Referring to FIG. 1 in detail, the polyphonic tone synthesizer of the above-identified patent, during a computational phase, loads a main register 34 with a computed master data set. Each word in the master data set has a value corresponding to the relative amplitude of a point on the waveform of the tone to be generated. Typically, 64 values are stored as part of the master data set to define one complete cycle of the waveform to be generated. Once the master data set is computed and stored in the main register 34, all as described in detail in the above-identified patent, the words are shifted in sequence to any one of a plurality of note shift registers, one of which is indicated at 35, there being one note shift register for each tone generator of the polyphonic tone generator. Only one tone generator is shown in FIG. 1. A note select circuit 40 selects which of the note shift registers is connected to the output of the main register 34 during transfer of the master data set to the tone generator. Shifting from the main register 34 to the note shift register 35 is in synchronism with the output of a note clock 37 associated with the selected tone generator by a clock select circuit 42. The note clock 37 is a voltage controlled oscillator whose frequency is set by operation of a selected key on the instrument keyboard to be a multiple of 64 times the fundamental frequency or pitch of the key-selected note. The note clock 37 is controlled in response to keys operated on the keyboard of the instrument in a manner described in the above-identified patent.

Once the 64 words in the main register 34 are transferred to the note shift register 35, a load select circuit 45 transfers the input to the register 35 from the output of the main register 34 to the output of the note shift register 35 to provide an end-around mode in which the words in the note shift register, at the same time they are shifted out of the register, are continuously recirculated back through the shift register at a rate controlled by the note clock 37. As the words are recirculated through the load select circuit 45, they are also applied to the input of a digital-to-analog converter 47 which converts the sequence of digital words to a varying analog voltage which corresponds in frequency and waveform to the tone being generated. This analog voltage is applied as the audio input to a sound system 11. It should be noted that the various select circuits are all controlled by the logic of an executive control in the manner described in the above-identified patent.

To produce the ensemble effect according to the teaching of the present invention, a slave note shift register 104 is added to one or more of the tone generators of the polyphonic tone synthesizer. As shown in FIG. 1, the master data set from the main register 34 is transferred to the slave note register 104 through a load select circuit 102 at the same time the master data set is transferred to the note shift register 35 through load select circuit 45. Shift pulses are applied to the slave note shift register 104 from the note clock 37 through a gate 108. The gate 108 is controlled by a flip-flop 103. The gate 108 is normally open whenever the flip-flop 103 is in its reset state. The flip-flop 103 is set by the overflow pulse from a modulo 64 counter 106 which counts clock pulses from the note clock 37. Thus after 64 shift pulses have been applied to the slave note shift register 104 through the gate 108, the flip-flop 103 is set and the gate 106 is closed. At the same time, the flip-flop 103 opens a gate 105 which passes the next clock pulse from the note clock source 37 to the reset input of the flip-flop 103. Thus for every 65 note clock pulses 37, only 64 pulses are used to shift the slave note shift register 104, the 65th pulse being blocked by the gate 108. As a result, each successive complete end-around shifting cycle of the slave note register 104 is delayed one note clock pulse interval relative to the note shift register 35.

The output words from the slave note shift register 104 are applied to a digital-to-analog converter 107. One of the words of course is applied to the converter 107 for two note clock intervals with each complete shifting cycle of the register 104. In this manner, the waveshape read out from the slave note shift register in effect contains 65 points per recycle period, but the words are read out at the same clock rate as the 64 points per period read out of the note shift register 35. The resulting tone produced by the output of the slave note shift register 104 and digital-to-analog converter 107 has a fundamental frequency or pitch which is 64/65 of that of the fundamental frequency of the tone produced by the output of the note shift register 35 and digital-to-analog converter 47. As a result, the audio signal produced by the output of the slave note shift register differs from the true pitch of the selected key by −26.84 cents. (Note: a difference of 1200 cents corresponds to one octave). This small frequency deviation of the second tone in a two-tone ensemble has been found to be musically effective. It will be evident that providing a different number of points in the master data set will produce other frequency deviations. In general, if the number of words in the master data set is W, then the frequency deviation in cents caused by adding a data point is:

$$C = \frac{1200}{\log^2} \times \log \frac{W+1}{W} \qquad (1)$$

Figure 2:
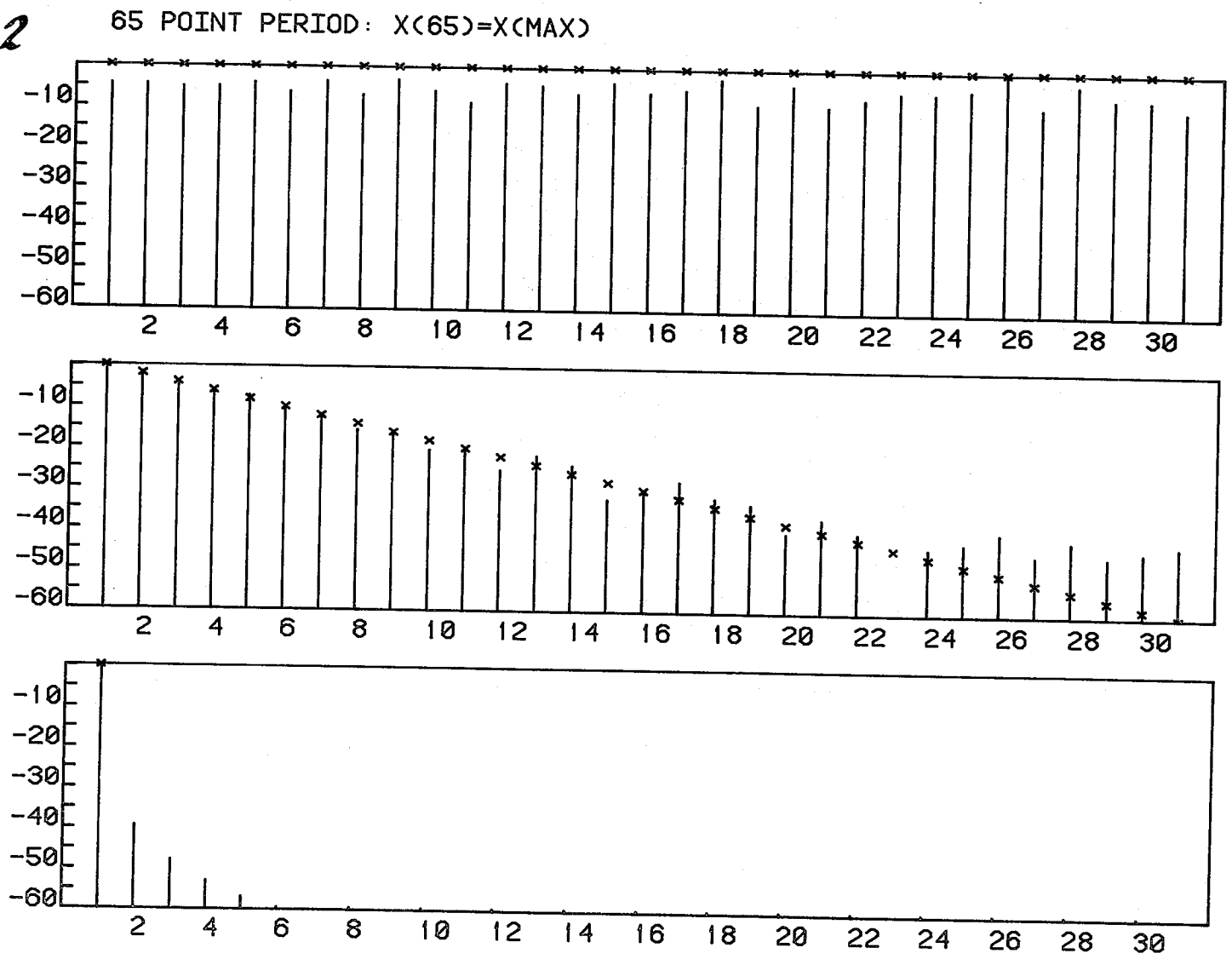
FIG. 2 illustrates the frequency spectra of signals generated by the system of FIG. 1.

FIG. 2 illustrates three spectral diagrams of signals generated by the system shown in FIG. 1. The X axis of these three curves are labeled with the harmonic numbers and the Y axis is the relative DB for each of the harmonics of output signals from the analog-to-digital converters. The top spectra in FIG. 2 is derived from a master data set computed from a set of harmonic coefficients all having the same value. The X marks are the spectral components for the signal outputs for the digital-to-analog converter 47. The solid spectral lines are for the signal output for the digital-to-analog converter 107. The middle spectrum is for a set of harmonic coefficients which decrease in value in steps of two DB. In the bottom spectrum, the harmonic coefficient is 0 for all but the fundamental or first harmonic.

Figure 3:
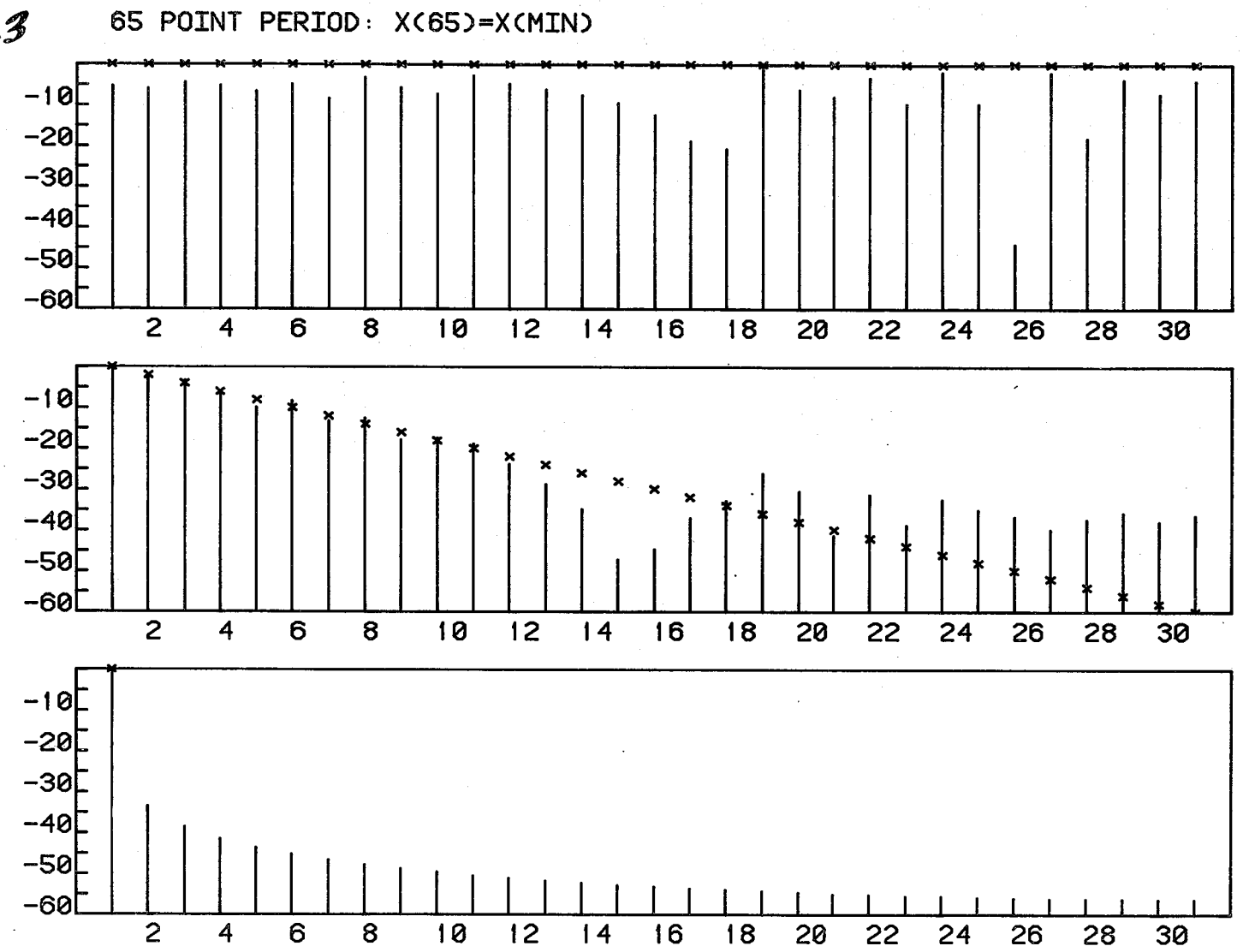
FIG. 3 shows a modification to the arrangement shown in FIG. 1.
Figure 4:
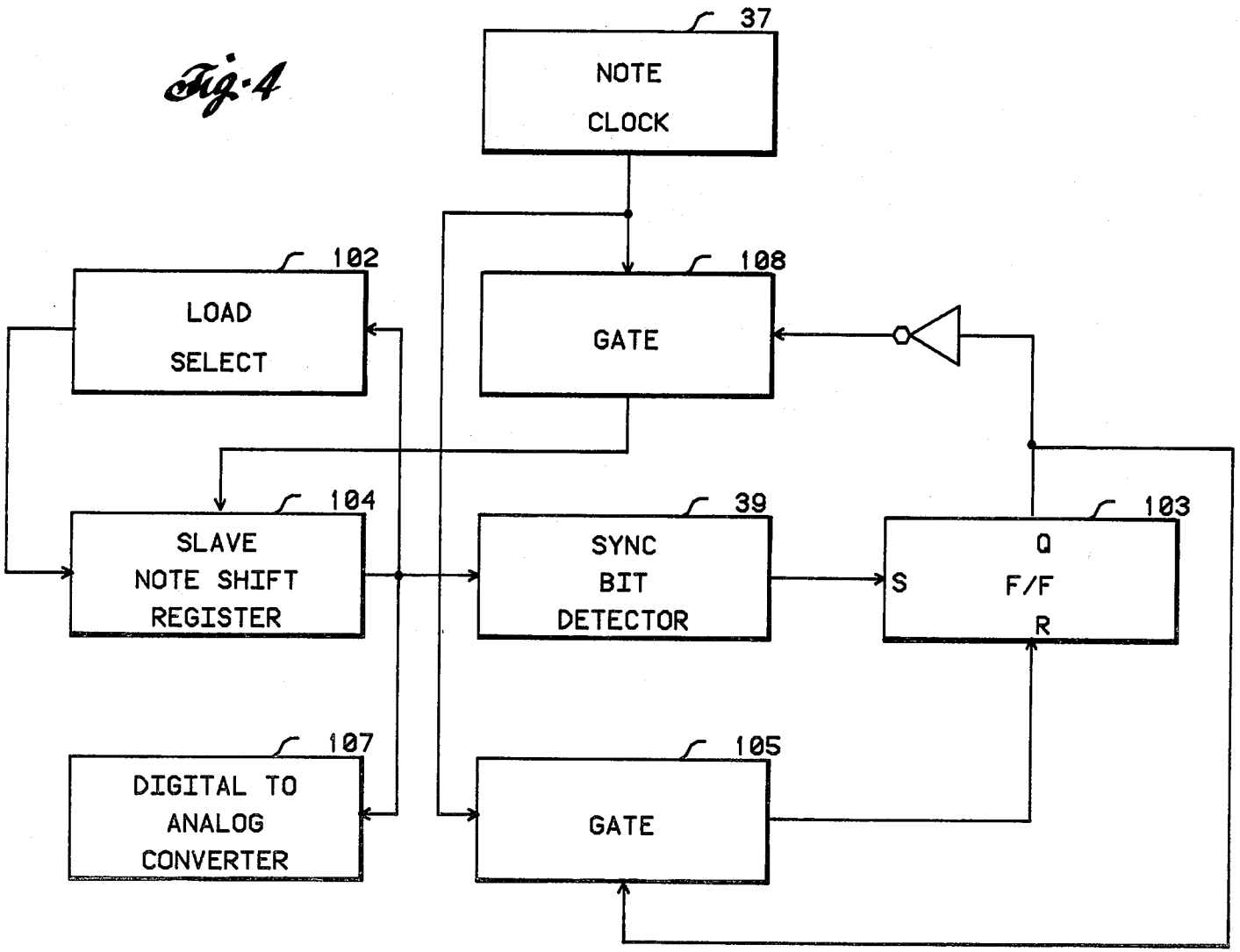
FIG. 4 shows the frequency spectra of signals generated by the modification of FIG. 3.

In all of the curves of FIG. 2, it is assumed that the repeated 65th value from the slave note shift register 104 was the maximum number in the master data set for each of the three input data sets. FIG. 3 shows a similar set of spectrum curves for the case in which the repeated point was placed as the first point in the master data set. It will be seen that the spectra of the output of the digital-to-analog coverter 107 varied depending upon which of the 65 points is the repeat point. In FIG. 1, the repeated point occurs randomly each time a tone is initiated. In FIG. 4, however, there is shown an arrangement by which the transfer of words in the master data set is always in fixed relationship to the counting of the clock pulses so that the repeated point is always placed as the first point in the master data set.

As described in the above-identified patent, a sync bit is used to load the note shift register. The sync bit allows the first word of a new master data set from the main resister to always be loaded in the note shift register so as to follow immediately the last word in the prior master data set stored in the note shift register. The sync bit allows loading of the note shift register without interruption with the generation of a tone from a previously stored master data set.

A sync bit detector 39 senses when a word having the sync bit stored in the slave note register 104 is shifted out in response to clock pulses from the note clock source 37. The sync bit detector sets the flip-flop 103 closing the gate 108 and interrupting the shifting of the slave note register 104 until the flip-flop 103 is reset. The flip-flop 103 is reset by the next clock from the note clock source 37 through a gate 105, the gate being opened by the flip-flop 103 when it is in the set state.

Figure 5:
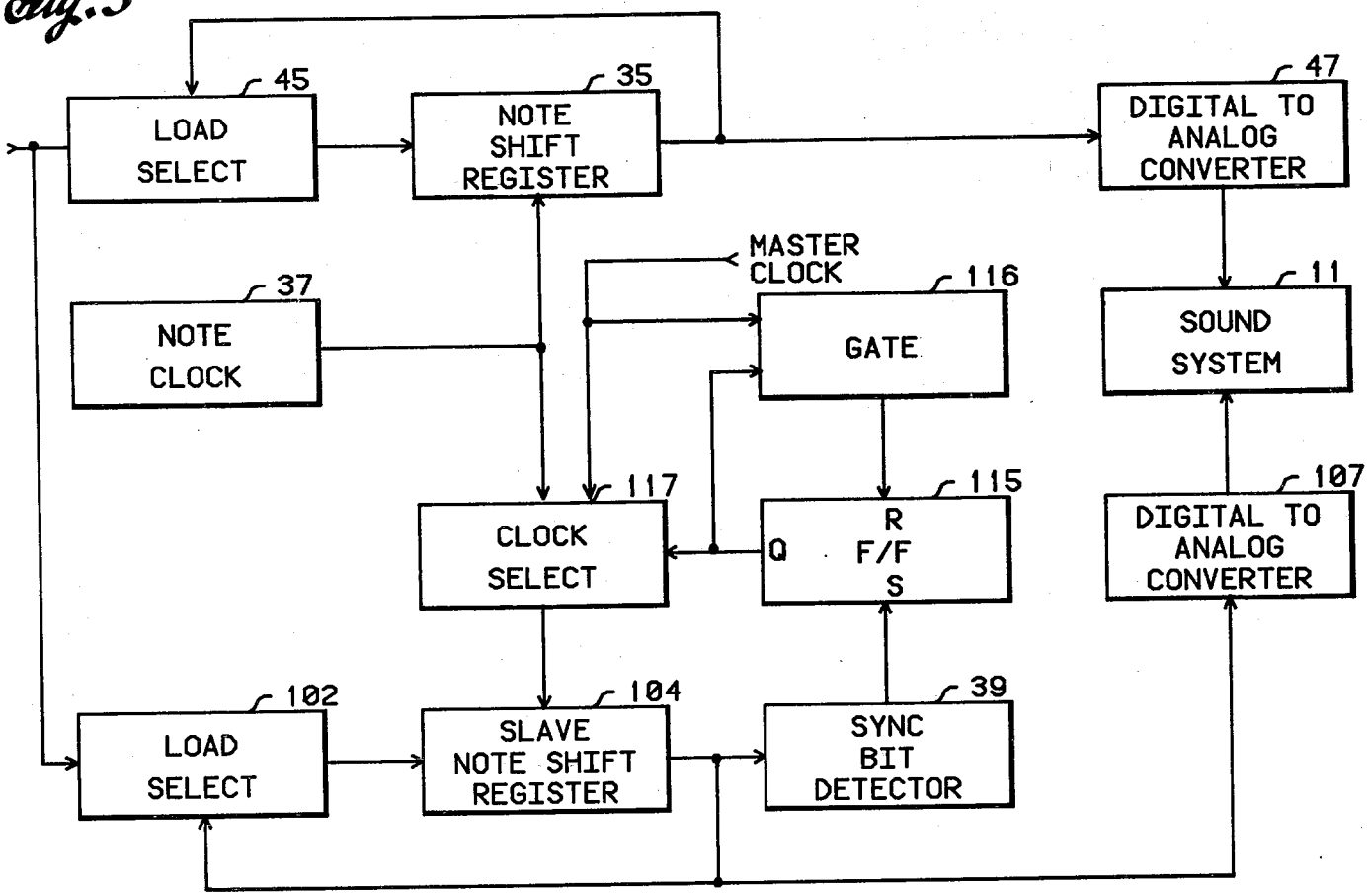
FIG. 5 shows a schematic block diagram of a further embodiment of the invention.
Figure 6:
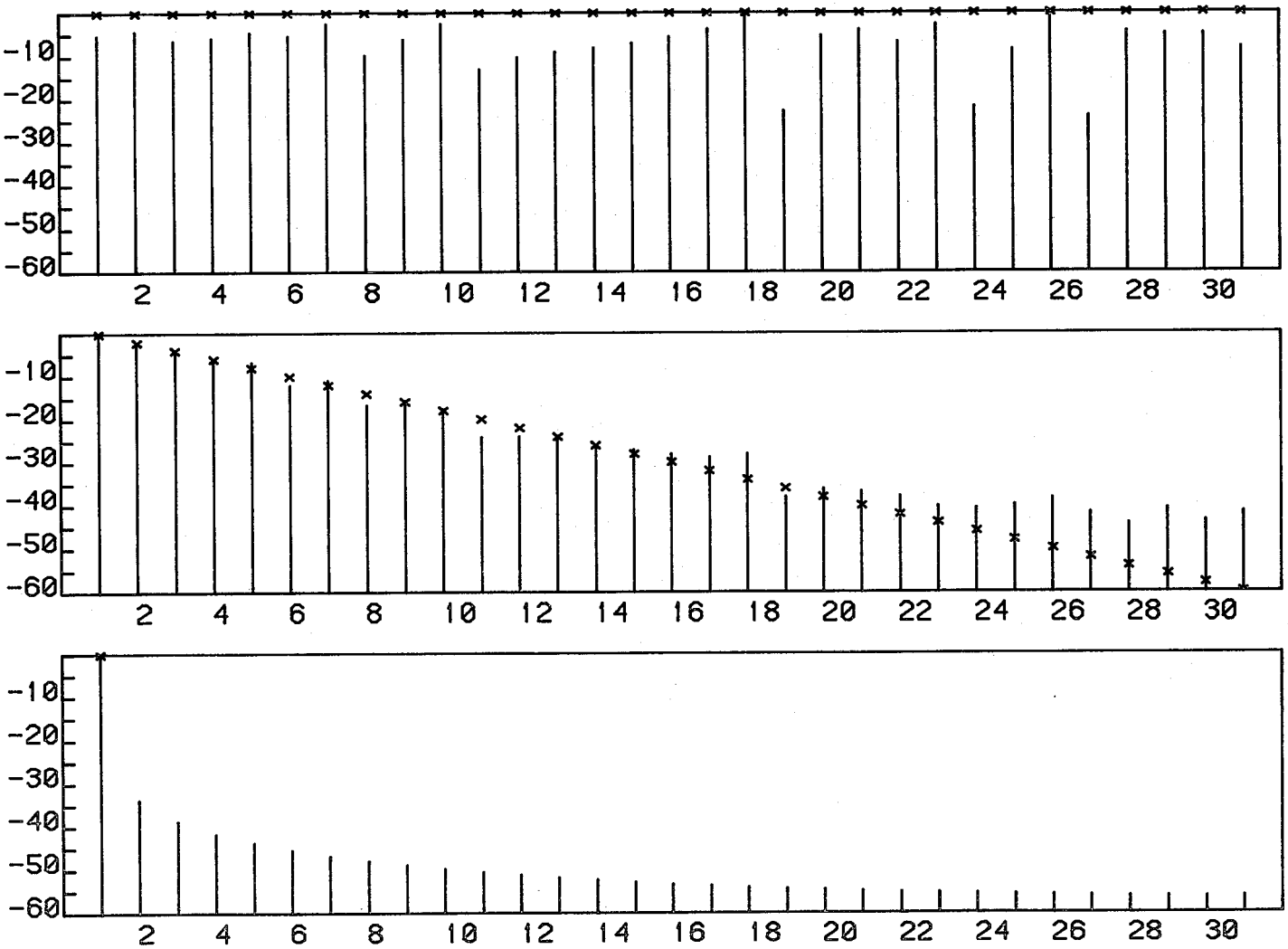
FIG. 6 shows the spectra data obtained from the embodiment of FIG. 5.

In an alternative system shown in FIG. 5, the offset tone is generated by eliminating one word during each repetitive cycle of the master data set, rather than repeating one word as in the arrangement of FIG. 1. The effect is to produce a waveshape having 63 points per period as compared to the standard 64 points per period. Using equation 1 above, the resulting offset frequency differs from the true frequency by +27.26 cents. In the arrangement of FIG. 5, the slave note shift register 104 is shifted an additional time during each complete shift cycle. This is accomplished by providing a control flip-flop 115 which is set by a sync bit shifted out of the slave note shift register 104. A clock select circuit 117 normally connects pulses from the note clock 37 to the shift input of the slave note shift register 104. When the control flip-flop 115 is set, it causes the clock select 117 to select pulses from the master clock. The control flip-flop 115 is reset by the next master clock passed by a gate 116 which is opened by the setting of the flip-flop 115. Since the master clock rate is at least 10 times faster than the highest note clock rate, the effect is to skip one word in the output from the slave note shift register 104 between one note clock and the next. FIG. 6 shows the resulting spectral data obtained from the system shown in FIG. 5.

Figure 7:
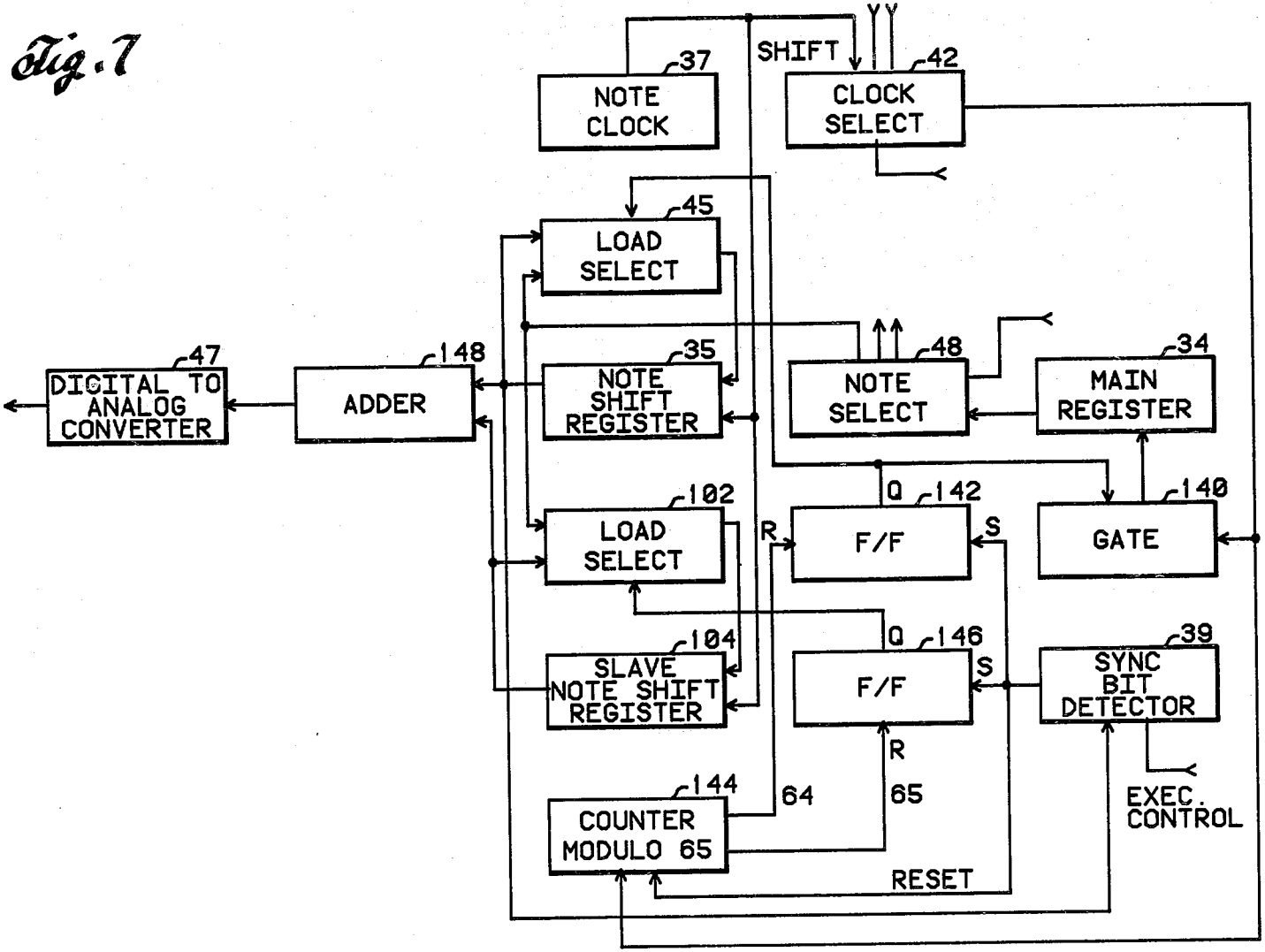
FIG. 7 shows yet another embodiment of the invention.

In the system shown in FIGS. 1, 4, and 5, both the note shift register and the slave note shift register store the 64 words of a master data set. However, the ensemble effect of the present invention may also be accomplished by utilizing shift registers which contain different numbers of words. Thus, in FIG. 7 the system is shown in which the slave note shift register 104 contains 65 words. Two word positions in the slave note shift register 104 receive the same word from the master data set. Thus, as shown in FIG. 7, the master data set is transferred from the main register 34 to both the note shift register 35 and slave note shift register 104 through one output of the note select circuit 48 and the respective load select circuits 45 and 102 in the same manner as described above. However, clock pulses from the note clock 37 are applied to the main register 34 through a gate 140 which is controlled by a flip-flop 142. The flip-flop 142 is set to open the gate 140 by the output of the sync bit detector 39 in response to a sync bit on the output of the note shift register 35 following a signal from the executive control indicating that a transfer cycle has been initiated. The output from the flip-flop 142 opens the gate 140 causing the main register 34 to begin shifting words to the load select circuit 145. The output of the flip-flop 142 also causes the load select circuit 45 to interrupt the end-around mode of the note shift register 35 and in turn cause the words from the main register 34 to be inserted into the note shift register 35 with each note clock pulse.

The output of the sync bit detector resets a modulo 65 counter 144 which counts in response to pulses from the note clock 37. After the counter 144 counts to 64, it resets the flip-flop 142 interrupting further shifting of the main register 34 and returning the load select circuit 45 to the end-around mode. The output from the sync bit detector 39 also sets a second control flip-flop 146, the output of which controls the load select circuit 102 to interrupt the end-around mode and cause the output of the main register 34 to be transferred to the input of the slave note shift register 104. The flip-flop 146 is reset by the counter 144 when it reaches a count of 65. It will be noted that the 65th clock pulse does not shift the main register 34 so that the same word on the output of the main register 34 is inserted in the slave note shift register 104 during two successive shifts of the register, thereby causing the same word to be stored in two successive positions in the slave note shift register 104. The 64 words stored in the note shift register 35 and the 65 words stored in the slave note shift register 104 are shifted in synchronism with the note clock pulses to an adder circuit 148, the output of which is applied to the digital-to-analog converter 47 for conversion to the audio tone. The digital adding of the two ensemble tones before conversion to the analog voltage produces the same functional result as using two converters and adding the analog voltages, in the manner described above in connection with FIGS. 1–6. The arrangement shown in FIG. 7 has the advantage that only one set of loading logic is needed for a plurality of tone generators since the loading logic can be time shared with transfers to any of the tone generators of the polyphonic tone generating system. Time sharing is controlled by means of the clock select circuit 37 which selects the appropriate note clock associated with the particular note shift register and slave shift register being loaded from the main register.

It should also be noted that the ensemble effect can be produced in the arrangement of FIG. 7 even though the 65th word transferred to the slave register is not directly derived from the output of the main register 34. Thus, the same control flip-flop 142 may be used to control both the load select circuits 45 and 102. The result is that the 65th word in the slave note shift register 104 will contain whatever word is left over from a previous set of data stored in the slave note shift register or some other random value.

Figure 8:
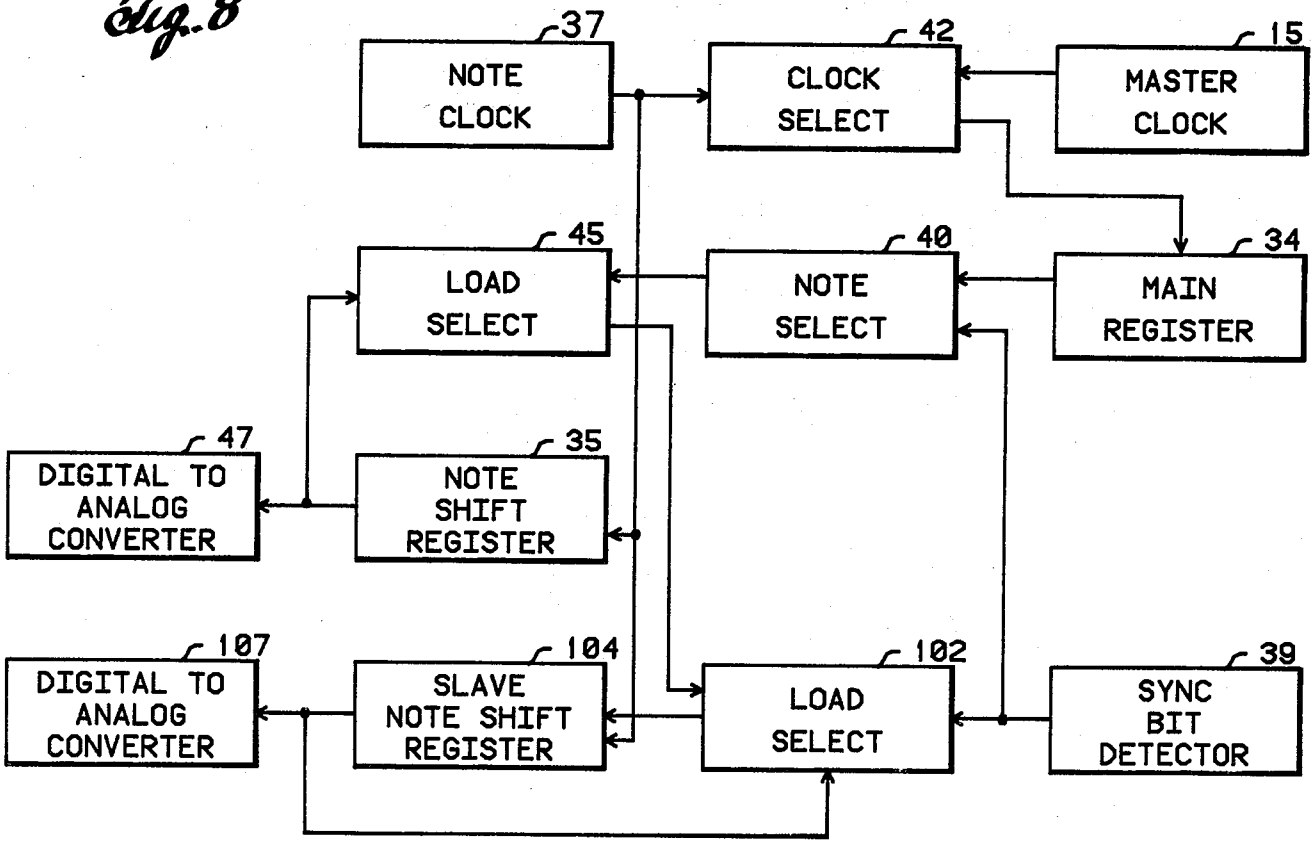
FIG. 8 is an alternative embodiment to that shown in FIG. 5.

Yet another embodiment is shown in FIG. 8. Slave shift register 104 provides one less word of storage than the note shift register 35, e.g. 63 words stored in the slave note shift register compared to 64 words stored in the note shift register 35. During the transfer operation from the main register 34, the first word transferred to the slave note register 104 is overwritten by the 64th word during the transfer operation. The subsequent transfer of 64 words against 63 words to the respective digital-to-analog converters 47 and 107 produces the same ensemble effect as that described above in connection with FIG. 5.

It will be appreciated that combinations of the several embodiments may be used to produce three ensemble tones rather than two. For example, by combining the arrangement of FIGS. 7 and 8, two slave note shift registers may be provided, one of which contains 63 words and one of which contains 65 words. As these two slave registers are shifted in synchronism with the note shift register 35, the effect is to produce three tones which are slightly different in frequency and harmonic content.

What is claimed is:

1. A tone generator including a first storage means for storing a predetermined number of digitally coded words corresponding to the relative amplitudes of equally spaced points defining one cycle of the waveform of a musical tone, second and third storage means, a clock pulse source having a pulse repetition frequency corresponding to a fixed integral multiple of the desired pitch of the tone being generated, means transferring said words from the first storage means to both the second and third storage means in corresponding sequence, digital-to-analog converter means, means transferring words from both the second and third storage means sequentially in repetitive cycles to the converter means, the converter means converting the respective sequential word outputs from the second and third storage means to an audio signal, the corresponding words being transferred out of the second and third storage means in response to each pulse from said clock pulse source, and means for delaying the transfer time of a word and each subsequent word from the third storage means relative to the corresponding word and each subsequent corresponding word in the second storage means by a predetermined integral number of clock pulses following each complete repetition of the sequential transfer from said second and third register to the converter means.

2. The apparatus of claim 1 wherein said fixed integral multiple between pulse repetition frequency of the clock pulse source and the pitch of the tone is equal to the number of words stored in the second storage means.

3. The apparatus of claim 1 wherein said means for shifting the transfer provides a shift of one clock pulse time for each repetitive cycle.

4. The apparatus of claim 3 wherein said means for shifting includes means for delaying the transfer of a word in the sequence from the third storage means by one clock pulse time interval during each repetitive cycle of the second storage means.

5. The apparatus of claim 4 further including means identifying a particular word in the second storage means, and means responsive to said means identifying a particular word for synchronizing the means for delaying the transfer with the shifting of said particular word to the converter.

6. The apparatus of claim 3 wherein said means for shifting includes means for shifting the third register by an additional pulse for each repetitive cycle of the second register.

7. The apparatus of claim 6 further including means identifying a particular word in the second register, and means responsive to said means identifying a particular word for synchronizing the additional shift of the third storage means with the shifting of said particular word.

8. Apparatus of claim 1 wherein the third storage means stores one more word than the second storage means, means for shifting one of the words from the first storage means to two word locations in the third storage means.

9. Apparatus of claim 1 wherein the third storage means stores one less word than the second storage means, and means for omitting one of the group of words transferred from the first storage means to the third storge means.

10. Apparatus of claim 1 wherein said converter means includes first and second converters connected respectively to the outputs of the second and third storage means, and means for adding the outputs of the first and second converters.

11. Apparatus of claim 1 wherein said converter means includes a single converter, and digital adder means for adding the words as they are shifted out of the second and third storage means, the output of the adder being applied to the single converter.

12. Apparatus for producing a musical tone having an ensemble effect wherein the waveshape of the tone is defined by a set of words defining the relative amplitude of equally spaced points along one cycle of the waveshape, said apparatus comprising first and second registers each storing said words in corresponding sequence, digital-to-analog converter means, means shifting said words in sequence at the same pulse rate simultaneously from both said first and second registers in repetitive sequence to the converter means, means fixing the pulse rate at a predetermined fixed multiple of the frequency of the tone being generated, and means for abruptly changing the relative phase between the time at which the corresponding words in said first and second registers are shifted out of their respective registers, the amount of phase change being an integral multiple of the period between successive words shifted out of said registers.

13. Apparatus of claim 12 wherein said means for changing the relative phase includes means for periodically interrupting the shifting of one of said registers for one pulse period.

14. Apparatus of claim 12 wherein said means for changing the relative phase includes means for periodically shifting one register twice during the time the other register is shifted once.

15. Apparatus of claim 12 wherein said first and second registers have unequal number of word storage locations, whereby the registers store different numbers of words of said set of words.

16. Apparatus of claim 15 wherein one of said registers stores one of said words in said set in two word locations.

17. Apparatus of claim 15 wherein one of said registers stores all of the words of said set and the other register stores all but one of the words of said set.

* * * * *